US008033640B2

(12) United States Patent
Koike et al.

(10) Patent No.: US 8,033,640 B2
(45) Date of Patent: Oct. 11, 2011

(54) FLUID DISCHARGING APPARATUS

(75) Inventors: Kaoru Koike, Matsumoto (JP); Hiroyuki Nakamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 369 days.

(21) Appl. No.: 12/360,965

(22) Filed: Jan. 28, 2009

(65) Prior Publication Data

US 2009/0189965 A1 Jul. 30, 2009

(30) Foreign Application Priority Data

Jan. 29, 2008 (JP) ..... 2008-018122

(51) Int. Cl.
*B41J 2/165* (2006.01)

(52) U.S. Cl. ..... 347/36

(58) Field of Classification Search ..... 347/20–22, 347/36, 95, 96, 102
See application file for complete search history.

(56) References Cited

U.S. PATENT DOCUMENTS 6,149,262 A * 11/2000 Shiida et al. ..... 347/37
7,651,213 B2 * 1/2010 Konno et al. ..... 347/102
7,753,516 B2 * 7/2010 Yoneyama ..... 347/102

FOREIGN PATENT DOCUMENTS

JP 2007-130790 5/2007

* cited by examiner

*Primary Examiner* — An Do
(74) *Attorney, Agent, or Firm* — Workman Nydegger

(57) ABSTRACT

A fluid discharging apparatus includes: nozzles configured to discharge fluid to a medium; a rotating member having a holding area configured to hold the medium and a non-holding area formed with an opening on a peripheral surface thereof and configured to rotate with the peripheral surface opposed to the nozzles; and a collecting mechanism configured to collect the fluid which does not adhere to the medium, the collecting mechanism including a suction unit configured to suck the fluid through the opening into the rotating member and a storage unit configured to store the fluid sucked into the rotating member.

5 Claims, 11 Drawing Sheets

FLUID DISCHARGING APPARATUS

CROSS-REFERENCE TO RELATED APPLICATIONS

This application claims priority under the Paris Convention based on Japanese Patent Application No. 2008-18122 (filed on Jan. 29, 2008).

BACKGROUND

Technical Field

The present invention relates to a fluid discharging apparatus. More specifically, the invention relates to a fluid discharging apparatus having nozzles for discharging fluid to a medium and a rotating member having a holding area for holding the medium on a peripheral surface thereof and rotating with the peripheral surface opposed to the nozzles.

A fluid discharging apparatus having nozzles for discharging fluid to a medium and a rotating member having a holding area for holding the medium on a peripheral surface thereof and rotating with the peripheral surface opposed to the nozzles is already known (for examples, see JP-A-2007-130790). In such a fluid discharging apparatus, the fluid discharged from the nozzles adheres to the medium held on the holding area of the rotating member and then is fixed to the medium.

The fluid discharged from the nozzles includes fluid which does not adhere to the medium. As such the fluid, for example, fluid which is forcedly discharged from the nozzles for preventing the nozzles from being clogged (that is, fluid to be discharged for flushing), or fluid floating in the fluid discharging apparatus after having discharged from the nozzles. When the fluid as such is left untreated, the interior of the fluid discharging apparatus might be contaminated by the fluid.

SUMMARY

An advantage of some aspects of the invention is to prevent the interior of a fluid discharging apparatus from being contaminated by fluid which does not adhere to a medium.

A fluid discharging apparatus according to an aspect of the invention including nozzles configured to discharge fluid to a medium, a rotating member having a holding area configured to hold the medium and a non-holding area formed with an opening on a peripheral surface thereof and configured to rotate with the peripheral surface opposed to the nozzles, and a collecting mechanism configured to collect the fluid which does not adhere to the medium, the collecting mechanism including a suction unit configured to suck the fluid through the opening into the rotating member and a storage unit configured to store the fluid sucked into the rotating member.

In this configuration, since the fluid which does not adhere to the medium is not left untreated but is collected by the collecting mechanism, the interior of the fluid discharging apparatus is prevented from being contaminated by the fluid.

Preferably, the collecting mechanism sucks the fluid into the rotating member through the opening by the suction unit and stores the fluid sucked into the rotating member in the storage in order to collect fluid discharged for flushing from the nozzles toward the opening.

In this configuration, the fluid discharged for flushing, which corresponds to the fluid which is not discharged to the medium is collected, so that the interior of the fluid discharging apparatus is prevented from being contaminated by the fluid.

Preferably, the fluid is ultraviolet-cured ink, an irradiator having an irradiating surface configured to irradiate the ultraviolet-cured ink adhered to the medium with ultraviolet rays is provided, the rotating member rotates with the peripheral surface opposed to the irradiating surface, the collecting mechanism collects the ultraviolet-cured ink floating in a clearance between the irradiating surface and the peripheral surface of the rotating member by sucking the ultraviolet-cured ink into the rotating member through the opening by the suction unit and storing the ultraviolet-cured ink sucked into the rotating member in the storage unit.

In this configuration, the ultraviolet-cured ink floating in the clearance between the irradiating surface and the peripheral surface of the rotating member, which corresponds to the fluid which does not adhere to the medium is collected, so that the irradiating surface is prevented from being contaminated by the ultraviolet-cured ink. Accordingly, the irradiating unit is allowed to irradiate the ultraviolet-cured ink adhered to the medium with ultraviolet rays adequately.

Preferably, the irradiating surface is positioned downstream from the nozzles in terms of the direction of rotation of the rotating member, air flows into a clearance between the irradiating surface and the peripheral surface of the rotating member from an upstream end and a downstream end of the irradiating surface in terms of the direction of rotation when the collecting mechanism sucks ultraviolet-cured ink floating in the clearance between the irradiating surface and the peripheral surface of the rotating member by the suction unit, and the inflow resistance generated when air flows from the downstream end of the irradiating surface in terms of the direction of rotation into the clearance between the irradiating surface and the peripheral surface of the rotating member is smaller than the inflow resistance generated when air flows from the upstream end of the irradiating surface in terms of the direction of rotation into the clearance between the irradiating surface and the peripheral surface of the rotating member.

In this configuration, an inflow of air from the upstream end which is closer to the nozzles from between the upstream end and the downstream end of the irradiating surface in terms of the direction of rotation is prevented while ultraviolet-cured ink floating in a clearance between the irradiating surface and the peripheral surface of the rotating member is sucked by the suction unit. Accordingly, the ultraviolet-cured ink floating near the nozzles is prevented from entering the clearance between the irradiating surface and the peripheral surface of the rotating member by the sucking action of the suction unit.

Preferably, the collecting mechanism includes a channel for fluid sucked through the opening, the channel being formed in the rotating member and rotating with the rotation of the rotating member, and the channel including a portion formed in the direction intersecting the direction from the center of the rotating member toward the opening.

In this configuration, fluid is prevented from splashing out from the rotating member through the opening by a centrifugal force acting on the fluid by the rotation of the rotating member when the fluid sucked through the opening moves in the channel.

Preferably, the channel is bent into a convoluted form when viewed in the direction of the rotating shaft of the rotating member.

In this configuration, the effect to prevent the fluid sucked through the opening from splashing out from the rotating member through the opening by the centrifugal force as described above is demonstrated more effectively.

Other characteristics of the aspect of the invention will be clarified by description in this specification and attached drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

An ink jet printer (hereinafter, referred to as a printer 10) will be described below as an example of a fluid discharging apparatus according to embodiments of the invention.

Example of Configuration of Printer 10

Figure 1:
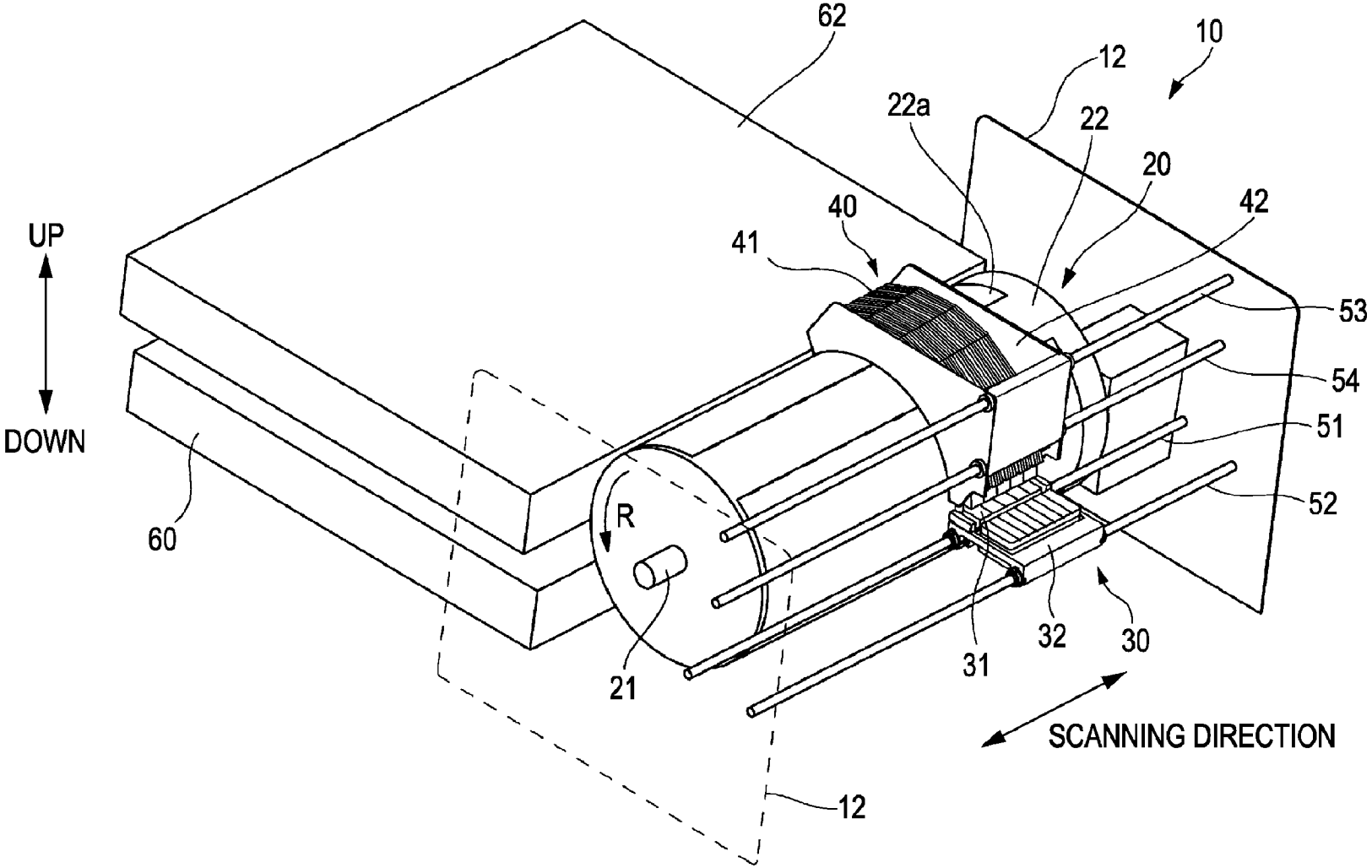
FIG. 1 is a perspective view schematically showing a configuration of a printer 10.
Figure 2:
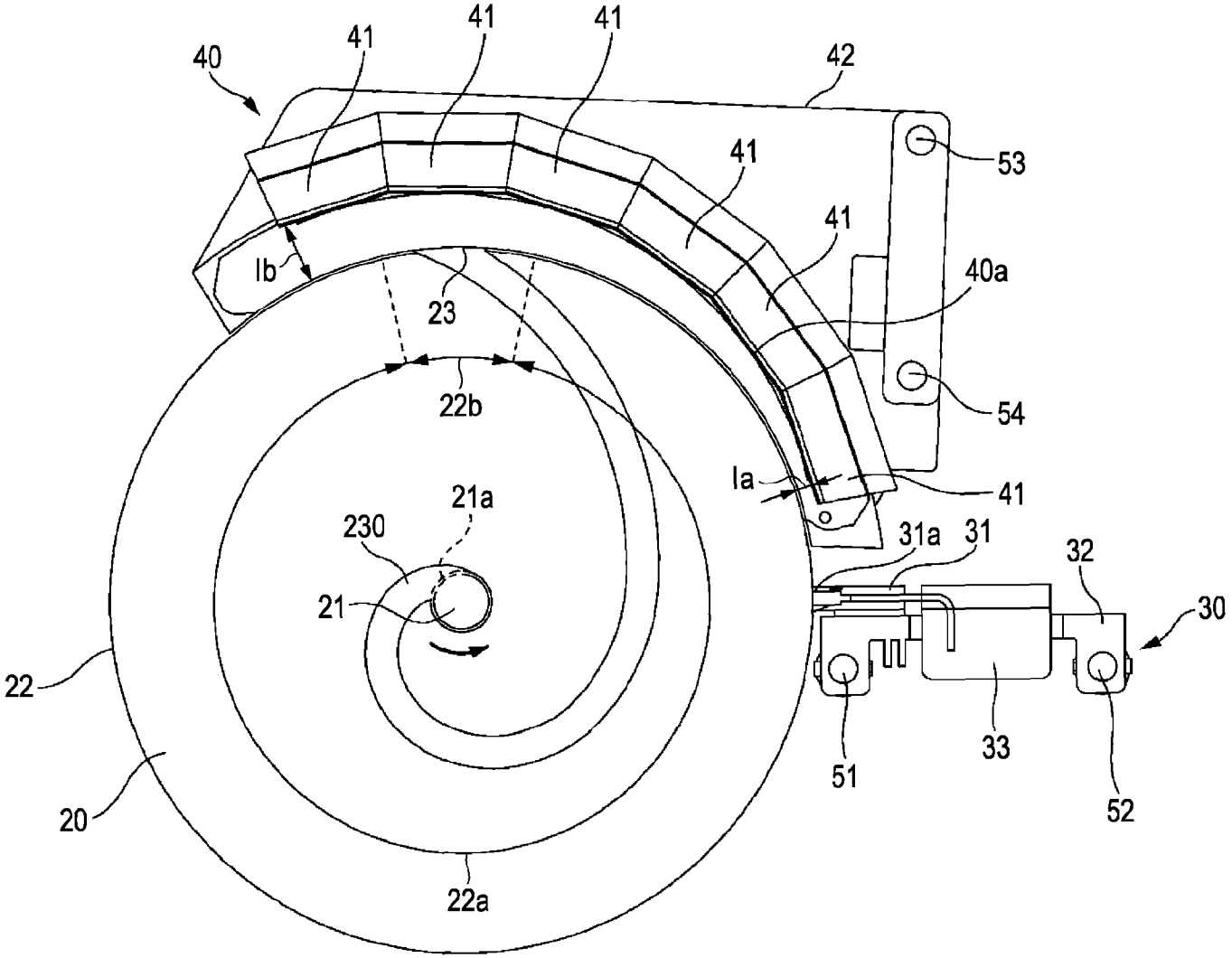
FIG. 2 is a cross-sectional view showing structures of a rotating drum 20 and peripheral devices.

Referring now to FIG. 1 and FIG. 2, an example of the configuration of the printer 10 will be described.

FIG. 1 is a perspective view schematically showing the configuration of the printer 10. In FIG. 1, the direction of up and down with respect to the printer 10 and the direction of movement (scanning direction) of heads 31 are indicated by arrows. FIG. 2 is a cross-sectional view showing structures of a rotating drum 20 and peripheral devices thereof. FIG. 2 shows a cross section the direction of a normal line of which corresponds to the direction of the axis of a rotating shaft 21 of the rotating drum 20.

The printer 10 in an embodiment is an apparatus configured to discharge ultraviolet-cured ink (hereinafter, referred to as UV ink) as an example of fluid to paper as an example of a medium on the basis of print data from a host computer, not shown, upon reception of the print data and print an image on the paper. The UV ink is ink which is prepared by adding an auxiliary substance such as antifoamer to a mixture of carrying liquid, photo-polymerization starter and pigment.

The printer 10 includes the rotating drum 20 as a rotating member, a head unit 30, and a UV irradiator 40 as an irradiator, as shown in FIG. 1.

The rotating drum 20 is a rotating member which rotates about the rotating shaft 21 in a state of holding paper on a peripheral surface 22 thereof. The rotating shaft 21 is rotatably supported by a pair of frames 12 opposed and arranged upright as shown in FIG. 1, and rotates when a drive force from a drive motor, not shown, is transmitted thereto. Accordingly, the rotating drum 20 rotates about the rotating shaft 21 at a constant angular velocity in the direction indicated by an arrow in FIG. 1 (the direction designated by reference sign R in FIG. 1).

In this embodiment, as shown in FIG. 2, the rotating drum 20 is provided with a holding area 22*a* for holding paper and a non-holding area 22*b* which does not hold paper on the peripheral surface 22 thereof. The non-holding area 22*b* is formed with a substantially rectangular opening 23 having a width slightly smaller than the length of the rotating drum 20 in the axial direction.

The head unit 30 is configured to discharge UV ink to paper held by the peripheral surface 22 (more accurately, the holding area 22*a*) of the rotating drum 20. The head unit 30 includes heads 31 and a head carriage 32 having the heads 31 mounted thereon as shown in FIG. 2.

The heads 31 each include a nozzle surface 31*a* opposed to the peripheral surface 22 of the rotating drum 20 and having nozzles formed thereon. In other words, the rotating drum 20 rotates with the peripheral surface 22 thereof opposing the nozzles. The nozzles are nozzles for discharging UV ink to paper held on the peripheral surface 22 of the rotating drum 20. The head carriage 32 is supported by guide shafts 51 and 52 extending along the rotating shaft 21 of the rotating drum 20, and reciprocates along the guide shafts 51 and 52. Therefore, the heads 31 are capable of reciprocating along the direction of axes of the guide shafts 51 and 52 by the movement of the head carriage 32. As shown in FIG. 2, an ink cartridge 33 having UV ink stored therein is detachably attached to the head carriage 32.

The UV irradiator 40 is configured to irradiate UV ink adhered to paper with ultraviolet rays. The UV irradiator 40 is positioned downstream from the head unit 30 in terms of the direction of rotation of the rotating drum 20. The UV irradiator 40 includes a plurality of lamp units 41 arranged in proper alignment in the direction of rotation of the rotating drum 20 and an irradiator carriage 42 configured to mount the plurality of lamp units 41.

The plurality of lamp units 41 each include an opposing surface which opposes the peripheral surface 22 of the rotating drum 20, and irradiates the peripheral surface 22 of the rotating drum 20 with ultraviolet rays emitted from a light source, not shown, from the opposing surface. In this manner, the opposing surfaces of the plurality of lamp units 41 are arranged in row in the direction of rotation of the rotating drum 20. The plurality of opposing surfaces arranged in the direction of rotation form an irradiating surface 40*a* that the UV irradiator 40 has for irradiation with ultraviolet rays. The rotating drum 20 rotates with the peripheral surface 22 thereof opposing the irradiating surface 40*a*. The irradiator carriage 42 is supported by guide shafts 53 and 54 extending along the rotating shaft 21 of the rotating drum 20, and is moved along the guide shafts 53 and 54. Therefore, the plurality of lamp units 41 move along the direction of axes of the guide shafts 53 and 54 by the movement of the irradiator carriage 42.

As described above, since the UV irradiator 40 is positioned downstream from the head unit 30 in terms of the direction of rotation of the rotating drum 20, the irradiating surface 40*a* is positioned downstream from the nozzles. In this embodiment, the distance from the irradiating surface 40*a* to the peripheral surface 22 of the rotating drum 20 is gradually increased from upstream to downstream in terms of the direction of rotation of the rotating drum 20. In other words, the distance from the downstream end of the irradiating surface 40*a* to the peripheral surface 22 (shown by the reference numeral 1*b* in FIG. 2) is longer than the distance from the upstream end of the irradiating surface 40*a* to the peripheral surface 22 (shown by the reference numeral 1*a* in FIG. 1) in terms of the direction of rotation.

Nozzles

Figure 3:
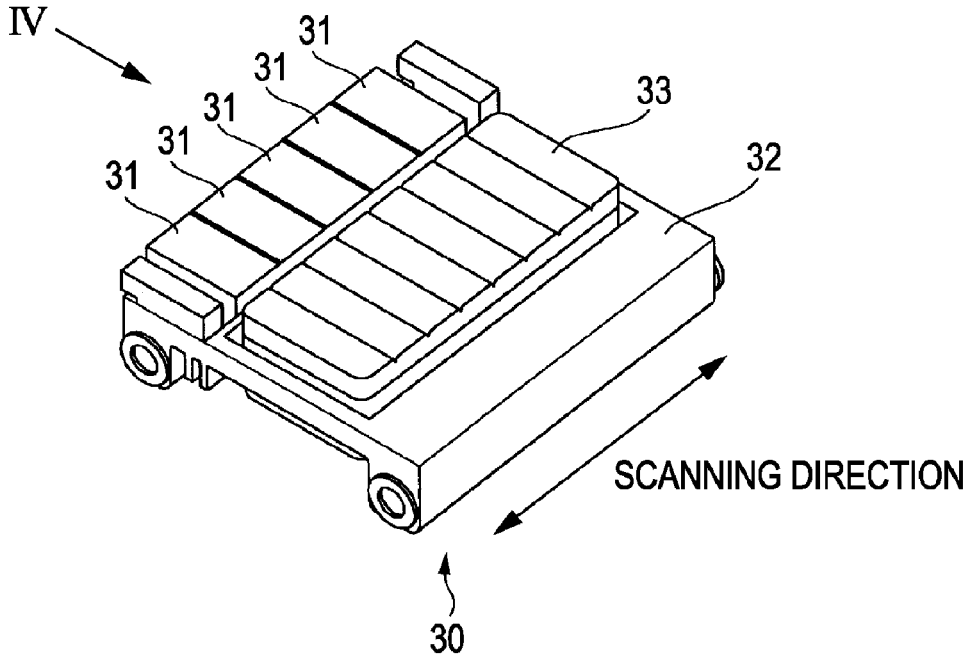
FIG. 3 is a perspective view of a head unit 30.
Figure 4:
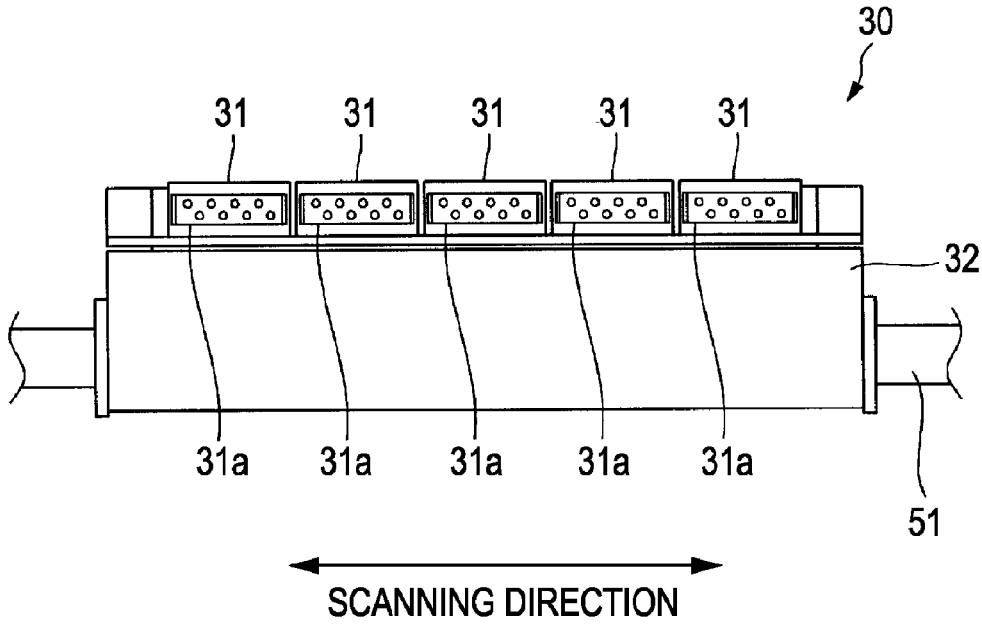
FIG. 4 is a drawing showing a nozzle surface 31*a*.

Referring now to FIG. 3 and FIG. 4, nozzles formed on the nozzle surfaces 31*a* of the heads 31 will be described. FIG. 3 is a perspective view of the head unit 30. FIG. 4 is a drawing showing the nozzle surfaces 31*a* viewing the head unit 30 in the direction indicated by an arrow IV in FIG. 3. The scanning direction of the heads 31 is shown in FIG. 3 and FIG. 4.

As shown in FIG. 3, a plurality of the heads 31 (five heads 31 in this embodiment) are provided in the head unit 30 in this embodiment in the state of being arranged in the scanning direction. The heads 31 each discharge UV ink being different in type. More specifically, the head 31 for discharging black UV ink, the head 31 for discharging cyan UV ink, the head 31 for discharging magenta UV ink, the head 31 for discharging yellow UV ink, and the head 31 for discharging white UV ink are provided.

As shown in FIG. 4, the nozzle surfaces 31*a* of the heads 31 each are formed with a plurality of nozzles arranged equidistantly along the scanning direction. The nozzles each include an ink chamber and a piezoelectric element (the ink chamber and the piezoelectric element both are not shown), and UV ink is discharged in the form of drops from the nozzles by contraction and expansion of the ink chamber by the operation of the piezoelectric element.

UV Irradiator 40

Figure 5:
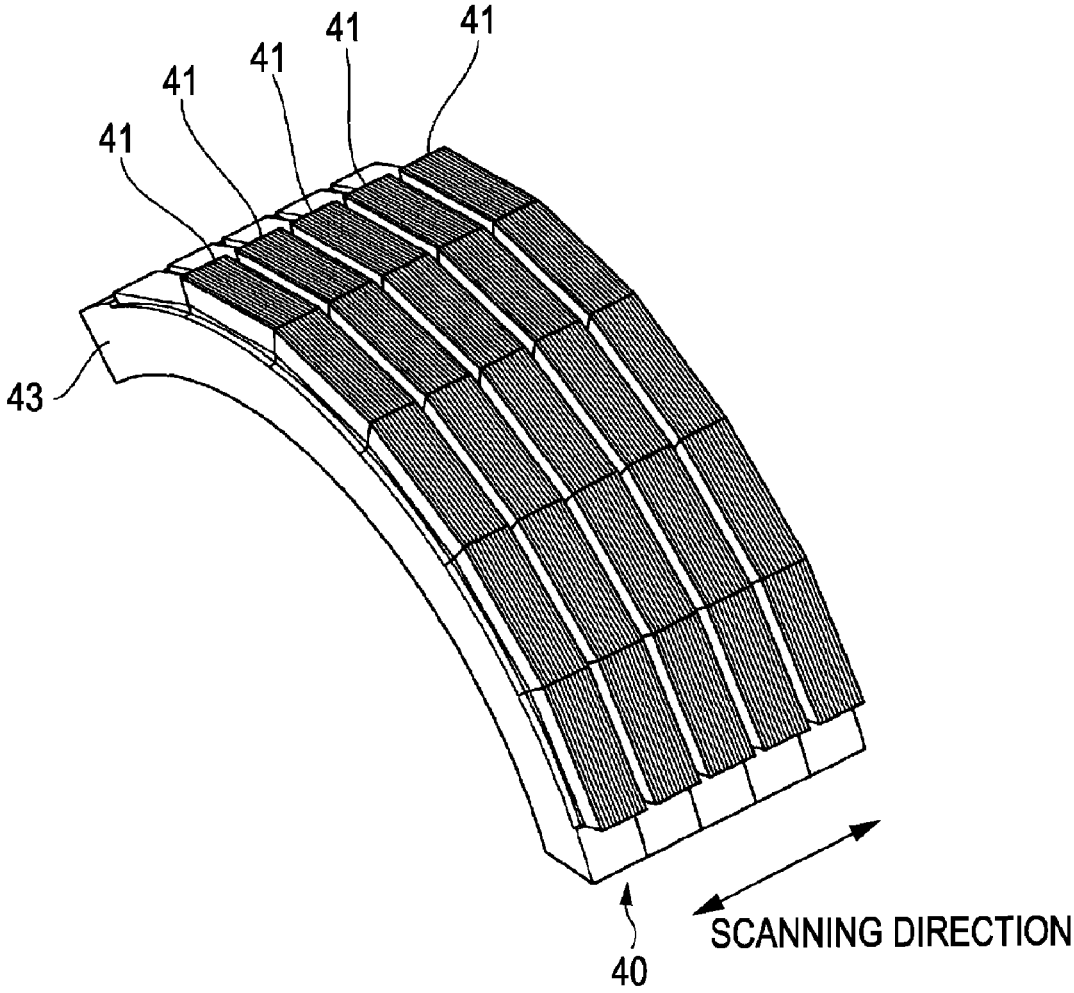
FIG. 5 is a perspective view of a UV irradiator 40.

Referring now to FIG. 5, the UV irradiator 40 will be described. FIG. 5 is a perspective view of the UV irradiator 40. In FIG. 5, a direction corresponding to the scanning direction of the heads 31 (indicated simply as SCANNING DIRECTION in FIG. 5) is indicated by an arrow.

The UV irradiator 40 in this embodiment includes the plurality of lamp units 41 arranged in proper alignment along the direction of rotation of the rotating drum 20 (hereinafter referred also to as a lamp unit row) by the number corresponding to the number of the heads 31. In other words, in this embodiment, the lamp unit row for the black UV ink, the lamp unit row for the cyan UV ink, the lamp unit row for the magenta UV ink, the lamp unit row for the yellow UV ink, and the lamp unit row for the white UV ink are provided. These lamp unit rows are mounted in a common holder 43 as shown in FIG. 5, and are arranged along the direction corresponding to the scanning direction of the heads 31. Therefore, a plurality of the irradiating surfaces 40*a* corresponding to the types of ink are arranged in the scanning direction.

Since the lamp unit rows are provided for the respective types of UV ink, setting of the wavelength and the irradiation strength of the ultraviolet rays to be irradiated from the lamp units 41 respectively for the corresponding types of UV ink is enabled. As a light source that the lamp units 41 may have, a metal halide lamp, a xenon lamp, a carbon ark lamp, a chemical lamp, a low pressure mercury lamp, a high pressure mercury lamp, and so on may be employed.

In this embodiment, the width of the each irradiating surface 40*a* in terms of the scanning direction is longer than the width of the nozzle surface 31*a* of the each head 31 in terms of the scanning direction.

Configuration of Control Unit 100

Figure 6:
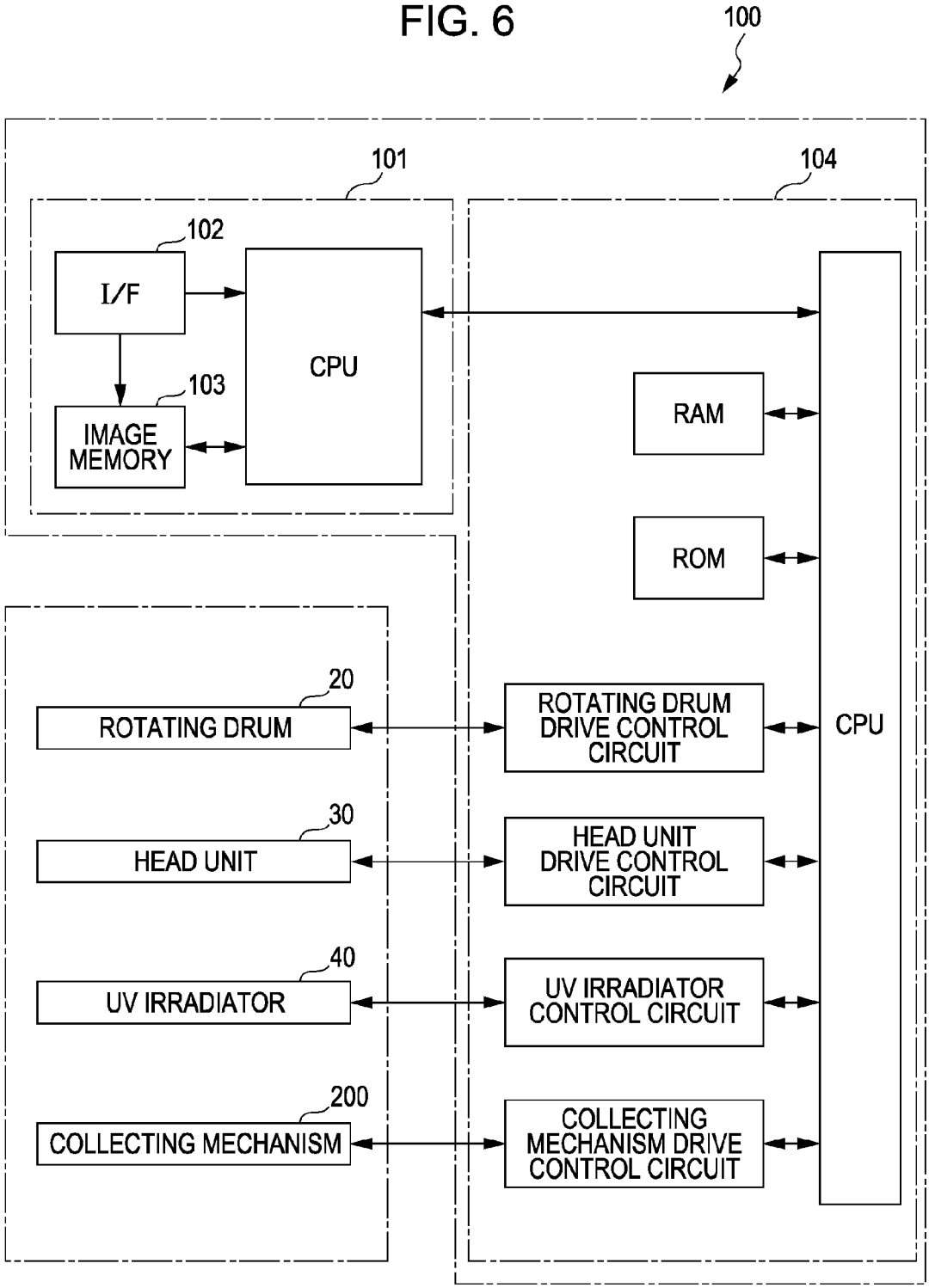
FIG. 6 is a block diagram showing a control unit 100 of the printer 10.

Referring now to FIG. 6, the configuration of a control unit 100 will be described. FIG. 6 is a block diagram showing the control unit 100 of the printer 10.

As shown in FIG. 6, a main controller 101 of the control unit 100 includes an interface 102 for the connection with a host computer (displayed as I/F in FIG. 6) and an image memory 103 configured to store image signals entered from the host computer.

The sub controller 104 is electrically connected to respective members (the rotating drum 20, the head unit 30, the UV irradiator 40, and so on) of the printer apparatus body, as shown in FIG. 6. Then, the sub controller 104 receives signals from sensors provided in the respective members and controls the respective members on the basis of signals entered from the main controller 101 while detecting the states of the respective members.

Operation of Printer

Subsequently, an example of operation (printing operation) for printing images on paper by the printer 10 configured as described above will be described.

First of all, when an image signal is entered from the host computer to the main controller 101 of the printer 10 via the interface 102, the sub controller 104 controls the respective members of the printer apparatus body on the basis of instructions from the main controller 101. Accordingly, the rotating drum 20 rotates and the UV irradiator 40 irradiates with ultraviolet rays.

In contrast, paper fed from a paper feeding unit 60 is transported to the rotating drum 20, and is wound around the rotating drum 20 with the widthwise direction thereof oriented along the rotating shaft 21 of the rotating drum 20. Then, the paper is held on the holding area 22*a* of the peripheral surface 22 of the rotating drum 20 by a holding mechanism (not shown) provided in the holding area 22*a*.

When the paper rotates with the rotating drum 20 by being held on the peripheral surface 22 of the rotating drum 20, UV ink is discharged from the nozzles of the respective heads 31. Then, the UV ink is dropped on a portion of the paper which opposes the nozzle surfaces 31*a* of the heads 31. At this time, since the paper is rotating, the portion of the paper which opposes the nozzle surfaces 31*a* of the heads 31 change in the direction intersecting with the paper width direction. Consequently, the paper is formed with dot lines along the direction intersecting the paper width direction.

When the portion of the paper where the UV ink is adhered is moved to a position opposing the irradiating surface 40*a* of the UV irradiator 40 by the rotation of the paper, the UV ink is irradiated with the ultraviolet rays. Accordingly, when the UV ink discharged from the nozzle adheres to the paper, the UV ink is immediately irradiated with ultraviolet rays, whereby the UV ink is cured. Consequently, the dot line formed on the paper is fixed.

Since the lamp units 41 (more accurately, the lamp unit rows) are provided for the respective types of UV ink, the UV ink adhered to the paper is irradiated with ultraviolet rays from the lamp unit 41 corresponding to the type thereof.

In this embodiment, since the plurality of lamp units 41 are arranged in the direction of rotation of the rotating drum 20 (in other words, since the irradiating surface 40*a* has a certain length in the direction of rotation), a sufficient time is secured for the portion of the paper where the UV ink is adhered until it opposes the irradiating surface 40*a*. Therefore, the UV ink adhered to the paper may be sufficiently irradiated with ultraviolet rays.

When the paper is further rotated and the portion of the paper where the UV ink is already adhered reaches the position where it is opposed to the nozzles again, the respective heads 31 move in the scanning direction. Then, the same operation as described above is carried out. Consequently, UV ink of a color different from the above-described UV ink adheres over the UV ink, which is already adhered to the paper, and is cured. Therefore, mixing of color of the uncured UV ink with UV ink of other colors is prevented.

In association with the movement of the respective heads 31 in the scanning direction, the respective lamp units 41 also move in the scanning direction. Accordingly, the respective lamp units 41 irradiate the UV ink of the types corresponding to the respective lamp units 41 with ultraviolet rays even after the respective heads 31 have moved away. Since the width of the irradiating surface 40*a* is longer than the width of the nozzle surface 31*a* of the each head 31, UV ink adhered to paper is sufficiently irradiated with ultraviolet rays even when the movement of the heads 31 is shifted in time to an extent from that of the lamp units 41.

As a result of the operation as described above carried out repeatedly, the dot lines of the respective colors are fixed over an entire image printing area of the paper. Accordingly, an image is printed finally on the paper. Then, the paper on which the image is printed is separated from the rotating drum 20, and is transported to the paper discharging unit 62.

Collection of UV Ink Does Not Adhere to Paper

UV ink which does not adhere to paper on the rotating drum 20 is present in UV ink discharged from the nozzles of the respective heads 31. If the UV ink which does not adhere to paper as such is left untreated, the interior of the printer 10 is contaminated by such the UV ink.

More specifically, as described in SUMMARY, the UV ink to be discharged from the nozzles for flushing (hereinafter, referred also to as "waste ink") or the UV ink which is floating in the printer 10 in the mist form after having discharged from the nozzles (hereinafter, referred also to as "ink mist") corresponds to the UV ink which does not adhere to paper. When such the UV ink is left untreated, the interior of the printer 10 is contaminated by the UV ink.

In particular, the printer 10 in this embodiment is provided with the UV irradiator 40 having the irradiating surface 40*a* configured to irradiate the UV ink with ultraviolet rays for fixing the UV ink adhered to paper. Then, when the UV ink which does not adhere to paper (for example, ink mist) adheres to the irradiating surface 40*a*, the UV ink is cured and accumulated on the irradiating surface 40*a*, which might result in contamination of the UV irradiator 40*a*. When the irradiating surface 40*a* is contaminated by the UV ink, the UV irradiator 40 will be suffered from proper irradiation of the UV ink adhered to paper with ultraviolet rays. Consequently, fixed spots of UV ink might be generated on paper and, eventually, deterioration in quality of images to be formed on paper might be resulted.

In contrast, in this embodiment, a collecting mechanism 200 configured to collect UV ink which does not adhere to paper is provided. Accordingly, contamination in the interior of the printer 10 by the UV ink which does not adhere to paper is prevented. The collecting mechanism 200 will be described below.

Configuration of Collecting Mechanism 200

Figure 7:
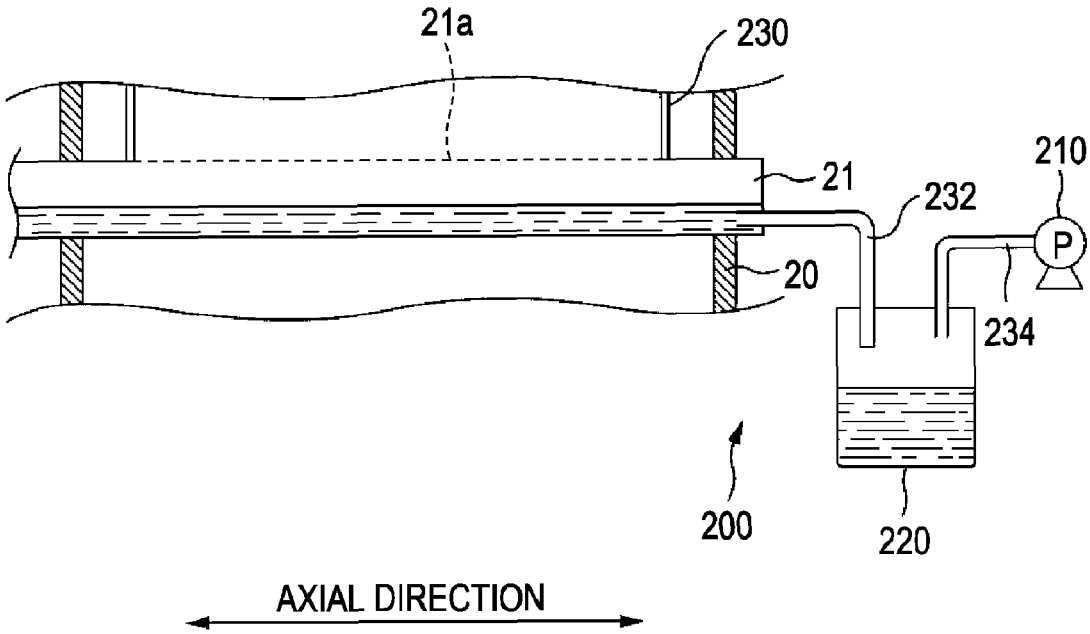
FIG. 7 is a concept drawing showing a collecting mechanism 200 according to an embodiment.

Referring now to FIG. 2 described above and FIG. 7, the configuration of the collecting mechanism 200 will be described. FIG. 7 is a concept drawing showing the collecting mechanism 200 in this embodiment. In FIG. 7, the direction of the center axis of the rotating drum 20 (that is, the direction of the axis of the rotating shaft 21, and in FIG. 7, it is indicated simply as AXIAL DIRECTION) is indicated by an arrow.

The collecting mechanism 200 in this embodiment is configured to suck UV ink which does not adhere to paper into the rotating drum 20 through the opening 23 formed in the non-holding area 22*b* of the peripheral surface 22 of the rotating drum 20, and collect the sucked UV ink to a predetermined collecting destination.

As shown in FIG. 7, the collecting mechanism 200 includes a suction pump 210 as a suction unit and a collecting tank 220.

The suction pump 210 is configured to suck UV ink which does not adhere to paper through the opening 23 into the rotating drum 20. The suction pump 210 then takes air in the periphery of the opening 23 into the rotating drum 20 through the opening 23 for sucking the UV ink from the opening 23. The collecting tank 220 is the collecting destination of the UV ink sucked into the rotating drum 20 by the suction pump 210, and is an air-tight tank in this embodiment.

The collecting tank 220 is positioned outside the rotating drum 20 as shown in FIG. 7. Then, in this embodiment, UV ink sucked through the opening 23 by the suction pump 210 is stored temporarily in the rotating drum 20 before being collected in the collecting tank 220. Therefore, a space for storing the UV ink is provided in the rotating shaft 21 in the interior of the rotating drum 20.

More specifically, in this embodiment, the rotating shaft 21 has a hollow shape, and UV ink sucked from the opening 23 is stored temporarily in the rotating shaft 21. In other words, UV ink sucked from the opening 23 passes through the interior of a duct 230, described later, and enters the rotating shaft 21. In an area of the peripheral surface of the rotating shaft 21 which is connected to the duct 230, an introduction hole 21*a* for guiding UV ink passed through the interior of the duct 230 into the rotating shaft 21 is formed.

As shown in FIG. 7, the interior of the rotating shaft 21 is communicated with the collecting tank 220 by a communication tube 232 attached to one end of the rotating shaft 21 in terms of the axial direction. On the other hand, the suction pump 210 is connected to a gas-phase area in the collecting tank 220 by the connecting tube 234. Also, the gas-phase area in the rotating shaft 21 is communicated with outside the rotating drum 20 by the duct 230. Therefore, when the suction pump 210 carries out a sucking operation, the gas-phase area in the collecting tank 220 and the gas-phase area in the rotating shaft 21 of the rotating drum 20 are depressurized, whereby UV ink present in the periphery of the opening 23 without adhering to paper is sucked into the rotating drum 20 through the opening 23 together with the air in the periphery of the opening 23. Then, the UV ink sucked into the rotating drum 20 enters the interior of the rotating shaft 21, then passes through the communication tube 232, and reaches the collecting tank 220.

As described above, in this embodiment, the UV ink sucked into the rotating drum 20 by the suction pump 210 is stored in the interior of the rotating shaft 21 of the rotating drum 20 and the collecting tank 220. In other words, the interior of the rotating shaft 21 and the collecting tank 220 constitute a storage unit of UV ink sucked into the rotating drum 20.

The collecting mechanism 200 also has a duct 230 as a passage of UV ink sucked from the opening 23. The duct 230 is formed in the rotating drum 20 and rotates with the rotating drum 20 as shown in FIG. 2. More accurately, the member which forms the duct 230 is attached to the interior of the rotating drum 20, and the member is rotated by the rotation of the rotating drum 20.

The duct 230 extends from the opening 23 to the peripheral surface of the rotating shaft 21 (more accurately, to an area of the peripheral surface where the introduction hole 21*a* is formed). The duct 230 in this embodiment is bent into a convoluted form when viewed in the axial direction of the rotating shaft 21 as shown in FIG. 2.

The collecting mechanism 200 having the configuration as described above is controlled by the sub controller 104 via a collecting mechanism drive control circuit (see FIG. 6). More specifically, the sub controller 104 controls the suction pump 210 to cause the collecting mechanism 200 to collect UV ink which does not adhere to paper. In this embodiment, the suction pump 210 is operated constantly during the period when the rotating drum 20 is rotated.

UV Ink Collecting Operation by Collecting Mechanism 200

Referring now to FIGS. 8A to 8D, the operation to collect UV ink which does not adhere to paper by the collecting mechanism 200 will be described. FIGS. 8A to 8D are drawings for explaining the operation to collect UV ink which does not adhere to paper. The collecting operation is proceeded in the order of FIG. 8A, FIG. 8B, FIG. 8C, and FIG. 8D.

In this embodiment, the operation to collect UV ink which does not adhere to paper is carried out during the rotating drum 20 rotates, and hence it may be operated while the printing operation described above.

As UV ink which does not adhere to paper to be collected by the collecting mechanism 200 includes waste ink discharged from the nozzles of the heads 31 for flushing and ink mist floating in the printer 10 as described above. In the description below, the operation to collect waste ink will be described first.

Figure 8A:
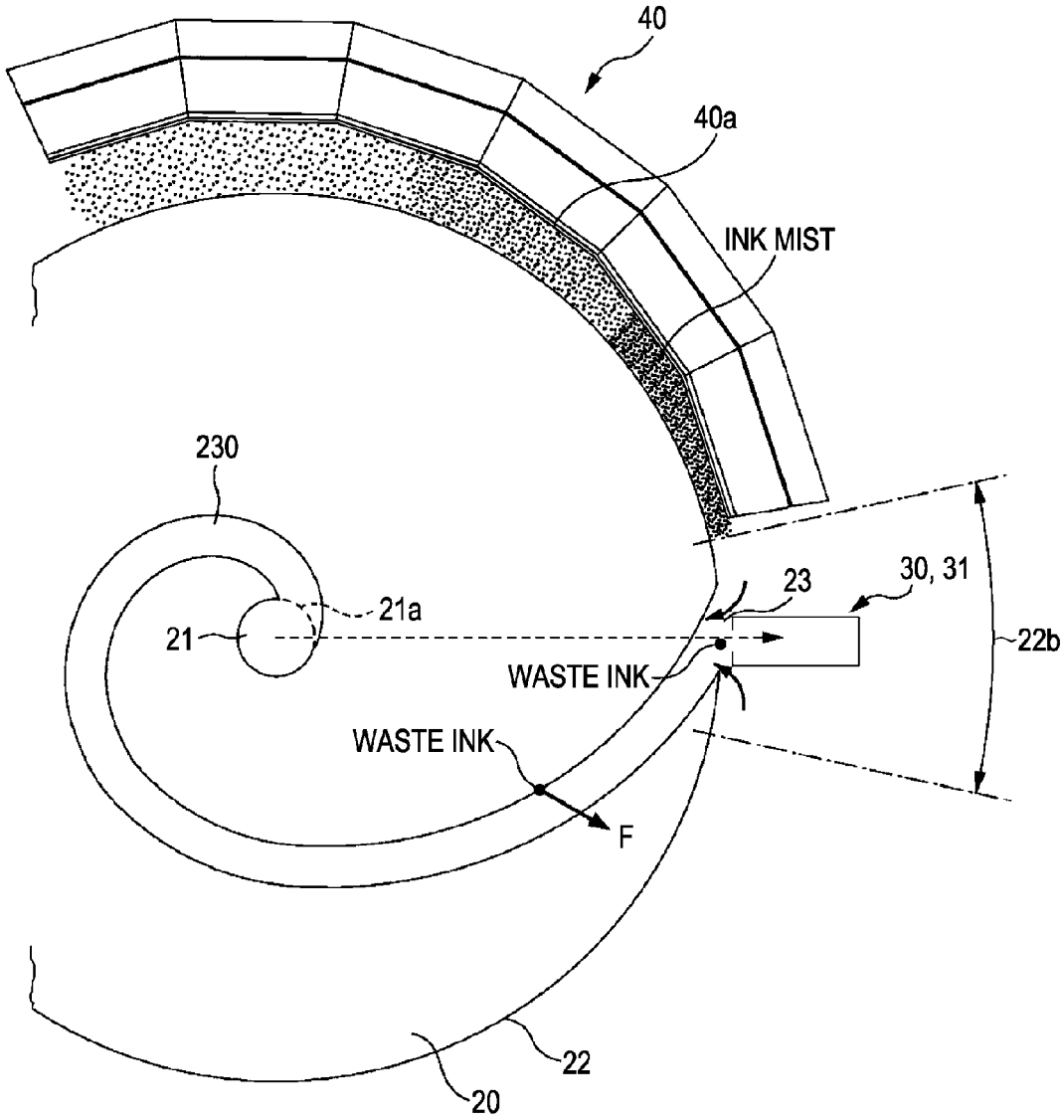
FIG. 8A is a first explanatory drawing for explaining a collecting operation for collecting UV ink which does not adhere to paper.

The suction pump 210 of the collecting mechanism 200 is operated constantly while the rotating drum 20 rotates as described above. Therefore, when UV ink is discharged from the nozzles toward the opening 23 for flushing in a case where the nozzles of the heads 31 are opposed to the opening 23 formed in the non-holding area 22*b* of the peripheral surface 22 of the rotating drum 20, the UV ink is sucked into the rotating drum 20 from the opening 23 together with the air in the periphery of the opening 23 as shown in FIG. 8A.

The term "flushing" here means an operation to forcedly discharge UV ink which is positioned near the nozzles and is increased in viscosity due to evaporation of solvent from the nozzle. Then, the flushing is carried out so as to avoid UV ink from adhering to the holding area 22*a* of the peripheral surface 22 of the rotating drum 20 and paper held in the holding area 22*a*. From this reason, the flushing is carried out when the nozzles of the heads 31 face the opening 23. In this embodiment, the flushing is carried out when there are nozzles which have not discharged UV ink for a long time present among the nozzles of the heads 31. However, the invention is not limited thereto, and the flushing may be carried out regularly.

UV ink discharged from the nozzles toward the opening 23 for the flushing, that is, wasted ink passes through the opening 23, then passes through the duct 230 formed in the rotating drum 20, and enters the interior of the rotating shaft 21. The waste ink is stored temporarily in the rotating shaft 21 and then is collected in the collecting tank 220 which is communicated with the interior of the rotating shaft 21.

As described above, when the waste ink is generated by the flushing when the nozzles of the heads 31 face the opening 23, the collecting mechanism 200 sucks the waste ink into the rotating drum 20 by the suction pump 210 for collecting the waste ink, and the waste ink sucked into the rotating drum 20 is stored in the rotating shaft 21 and the collecting tank 220.

In contrast, since the rotating drum 20 is continuously rotated while waste ink is being passed through the duct 230, a centrifugal force F is applied to the waste ink which is adhered to an inner wall of the duct 230 (see FIG. 8A). Therefore, the waste ink may be splashed in the direction in which the centrifugal force F acts. In such a case, when the opening 23 is present in front in the direction of splash of the waste ink (that is, in the direction in which the centrifugal force F acts), the waste ink sucked by the rotating drum 20 might splash out from the rotating drum 20 again through the opening 23.

In contrast, in this embodiment, the end of the duct 230 on the side of the opening 23 is formed in the direction intersecting the direction from the center of the rotating drum 20 (the center of rotation) toward the opening 23 (the direction indicated by a dotted arrow in FIG. 8A). In other words, the duct 230 in this embodiment includes a portion formed in the direction intersecting the direction from the center of the rotating drum 20 toward the opening 23. Therefore, in a case where the centrifugal force F acts on waste ink when the waste ink is passing through the duct 230 and the waste ink splashes in the direction in which the centrifugal force F acts, the opening 23 is not present but the inner wall of the duct 230 is present in the direction of splash. Therefore, even when the waste ink is splashed by the centrifugal force F, the waste ink hits on the inner wall and can hardly reach the opening 23. Consequently, in this embodiment, waste ink is prevented from splashing out from the rotating drum 20 through the opening 23.

In this embodiment, the duct 230 is bent into a convoluted form when viewed in the axial direction of the rotating shaft 21 of the rotating drum 20 as described above. In other words, the direction of formation of the respective members of the duct 230 intersects the radial direction of the rotating drum 20, and even when a centrifugal force F acts on waste ink in the respective members and the waste ink splashes, the waste ink hits immediately on the inner wall of the duct 230. Therefore, the waste ink is prevented from splashing out from the rotating drum 20 through the opening 23 further effectively.

Figure 8B:
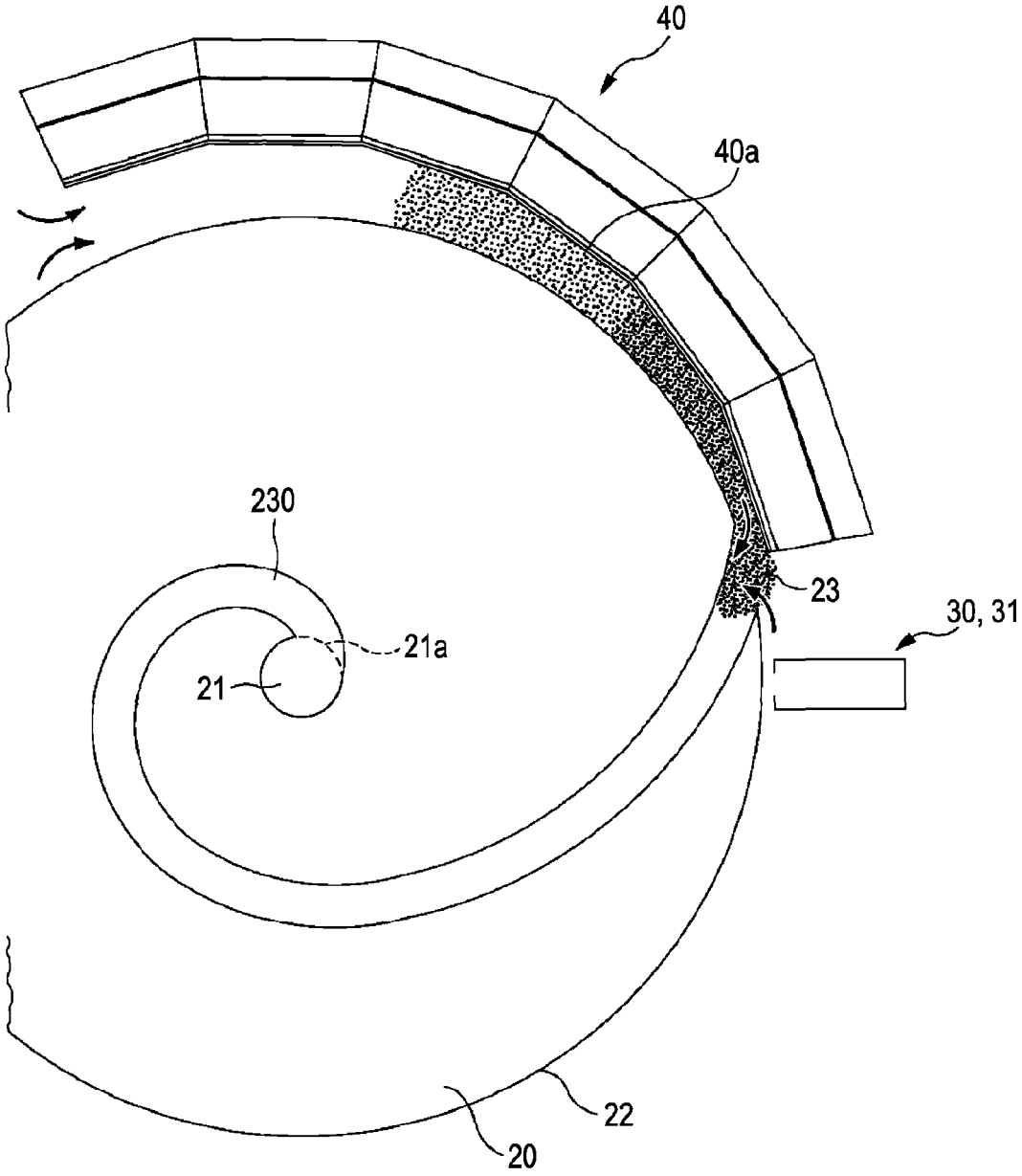
FIG. 8B is a second explanatory drawing for explaining the collecting operation for collecting UV ink which does not adhere to paper.

Subsequently, when the irradiating surface 40*a* of the UV irradiator 40 comes to oppose the opening 23 by the further rotation of the rotating drum 20, ink mist floating in a clearance between the irradiating surface 40*a* and the peripheral surface 22 of the rotating drum 20 is sucked through the opening 23 with air near the opening 23 as shown in FIG. 8B. The ink mist is originally part of UV ink discharged from the nozzles for being dropped on paper or part of UV ink discharged from the nozzles for the flushing, which is splashed in a mist form. The ink mist floats in the printer 10, and part of it enters a clearance between the irradiating surface 40*a* of the UV irradiator 40 positioned downstream from the nozzles in terms of the direction of rotation of the rotating drum 20 and the peripheral surface 22 of the rotating drum 20 as shown in FIGS. 8A and 8B.

Then, since the suction pump 210 is operated during a period when the irradiating surface 40*a* of the UV irradiator 40 is opposed to the opening 23, the collecting mechanism 200 collects ink mist floating in a clearance between the irradiating surface 40*a* and the peripheral surface 22 of the rotating drum 20 during this period. In other words, the collecting mechanism 200 sucks the ink mist through the opening 23 into the rotating drum 20 by the suction pump 210, and stores the ink mist sucked into the rotating drum 20 in the rotating shaft 21 and the collecting tank 220.

Accordingly, since the irradiating surface 40*a* is prevented from being contaminated by the ink mist which is adhered to the irradiating surface 40*a*, the UV irradiator 40 is allowed to irradiate with ultraviolet rays adequately. Consequently, UV ink adhered to paper (that is, UV ink discharged for printing images and hence is adhered to paper) receives ultraviolet rays adequately. Therefore, the fixed spots of UV ink on paper generated by contamination of the irradiating surface 40*a* by the ink mist as described above is prevented.

Figure 8C:
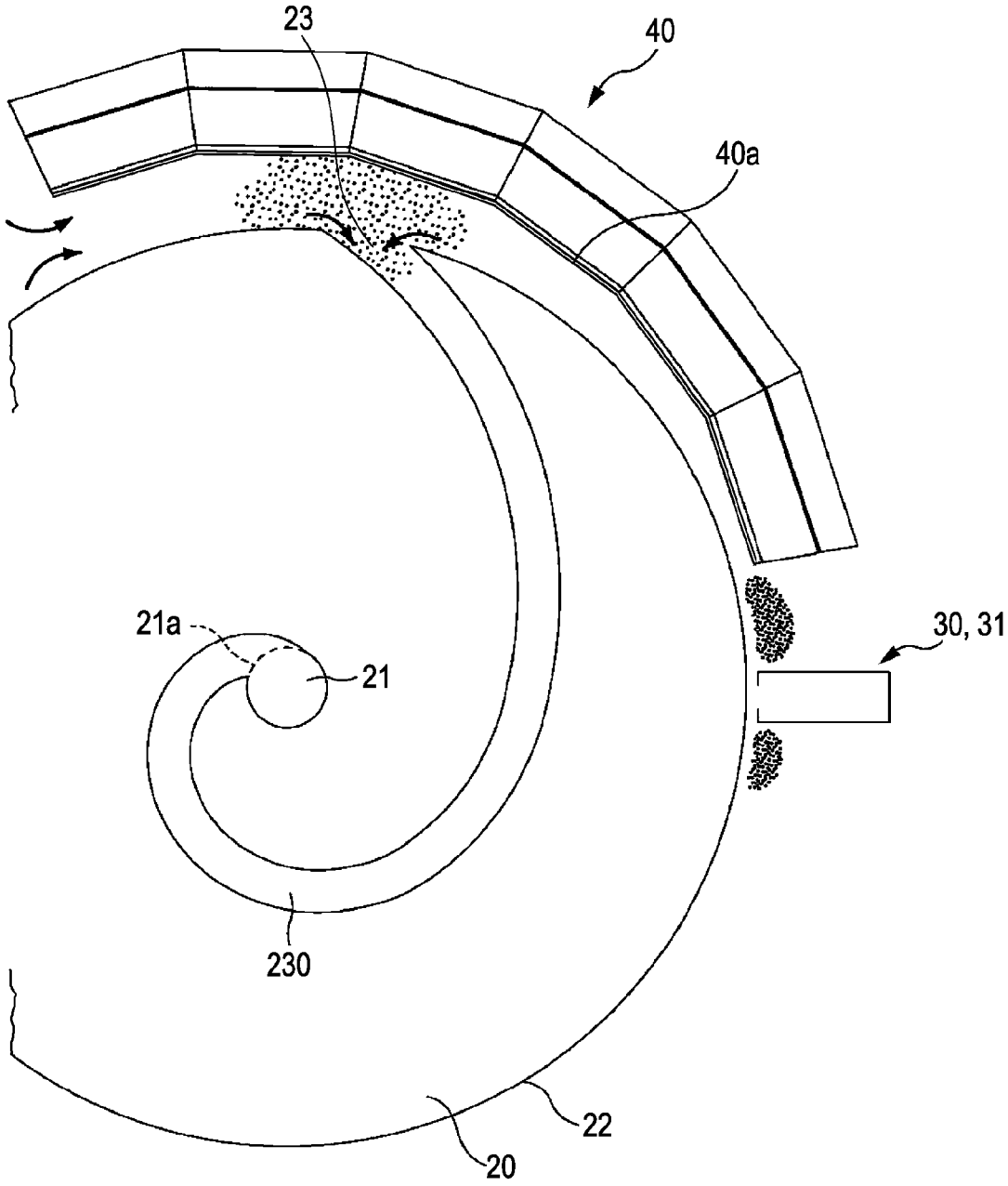
FIG. 8C is a third explanatory drawing for explaining the collecting operation for collecting UV ink which does not adhere to paper.

Collection of ink mist floating in a clearance between the irradiating surface 40*a* and the peripheral surface 22 of the rotating drum 20 is continuously carried out from when the upstream end of the irradiating surface 40*a* in terms of the direction of rotation of the rotating drum 20 starts to oppose the opening 23 until when the downstream end of the irradiating surface 40*a* ends to oppose the opening 23 in association with the rotation of the rotating drum 20 as shown in FIGS. 8B and 8C in association with the rotation of the rotating drum 20 as shown in FIGS. 8B and 8C. While the ink mist is being collected, air near the opening 23 is taken into the rotating drum 20 together with the ink mist. Consequently, when the collecting mechanism 200 sucks the ink mist floating in the clearance between the irradiating surface 40*a* and the peripheral surface 22 of the rotating drum 20 by the suction pump 210, air is caused to flow from the upstream and downstream ends of the irradiating surface 40*a* in terms of the direction of rotation into the clearance between the irradiating surface 40*a* and the peripheral surface 22 of the rotating drum 20 toward the opening 23.

In this embodiment, since the distance 1*b* from the downstream end of the irradiating surface 40*a* to the peripheral surface 22 of the rotating drum 20 is longer than the distance 1*a* from the upstream end of the irradiating surface 40*a* to the peripheral surface 22 as described above, air is able to flow from the downstream end more easily as shown in FIGS. 8B and 8C. In other words, the inflow resistance generated when air flows from the downstream end of the irradiating surface 40*a* into the clearance between the irradiating surface 40*a* and the peripheral surface 22 of the rotating drum 20 is smaller than the inflow resistance generated when air flows from the upstream end of the irradiating surface 40*a* into the clearance between the irradiating surface 40*a* and the peripheral surface 22.

The term "inflow resistance" used here is a hardness of air flow (in other words, pressure losses sustained when the air flows), and the smaller the inflow resistance is, the more the quantity of air flow becomes. The inflow resistance is decreased with increase in distance between the irradiating surface 40*a* and the peripheral surface 22 (in other words, with increase in width of an inlet port for allowing air to flow into the clearance between the irradiating surface 40*a* and the peripheral surface 22).

In other words, in this embodiment, a larger quantity of air flows into the clearance between the irradiating surface 40*a* and the peripheral surface 22 of the rotating drum 20 from the downstream end of the irradiating surface 40*a* in terms of the direction of rotation. On the contrary, air is restrained from flowing in from the upstream end of the irradiating surface 40*a* in terms of the direction of rotation, that is, from the end closer to the nozzles. Therefore, in a case where ink is discharged from the nozzles while the suction pump 210 sucks the ink mist floating in the clearance between the irradiating surface 40*a* and the peripheral surface 22 and hence the ink mist is newly generated near the nozzles (see FIG. 8C), the ink mist near the nozzles may be restrained from being drawn into the clearance between the irradiating surface 40*a* and the peripheral surface 22 by the sucking action of the suction pump 210.

In this manner, the purpose of restraining the ink mist near the nozzles from entering the clearance between the irradiating surface 40*a* and the peripheral surface 22 of the rotating drum 20 by the sucking action of the suction pump 210 is to prevent the irradiating surface 40*a* from being contaminated by the ink mist entered into the clearance between the irradiating surface 40*a* and the peripheral surface 22 and adhered to the irradiating surface 40*a*. In other words, the contamination of the irradiating surface 40*a* by the UV ink is specifically required to be avoided from the reasons described above.

Therefore, in a case where ink mist is generated newly near the nozzles while the suction pump 210 sucks the ink mist floating in the clearance between the irradiating surface 40*a* and the peripheral surface 22, the newly generated ink mist is restrained from entering the clearance between the irradiating surface 40*a* and the peripheral surface 22 by the sucking action of the suction pump, so that the ink mist is kept near the nozzles. Ink mist floating near the nozzles is sucked and collected into the rotating drum 20 through the opening 23 by the suction pump 210 when the nozzles are opposed again to the opening 23 by the rotation of the rotating drum 20.

Although a centrifugal force F acts on ink mist by the rotation of the rotating drum 20 when the ink mist sucked through the opening 23 passes through the duct 230, the ink mist is prevented from splashing out from the rotating drum 20 through the opening 23 even when the ink mist is splashed in the direction in which the centrifugal force F acts.

Figure 8D:
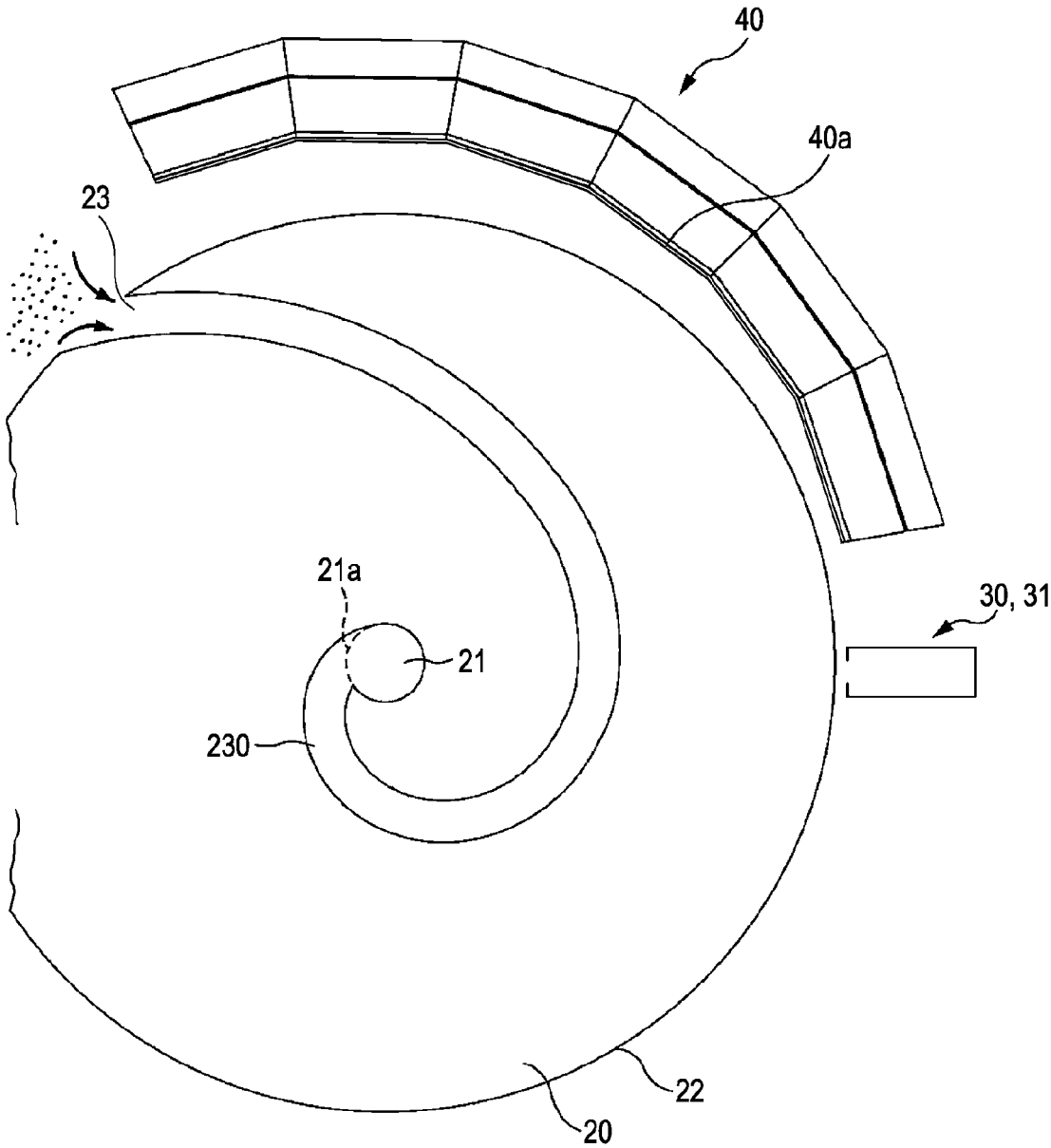
FIG. 8D is a fourth explanatory drawing for explaining the collecting operation for collecting UV ink which does not adhere to paper.

Thereafter, even after the downstream end of the irradiating surface 40*a* is ended to oppose the opening 23 by the further rotation of the rotating drum 20, the suction pump 210 is continued to be operated. Therefore, even after the downstream end of the irradiating surface 40*a* is ended to oppose the opening 23, the collecting mechanism 200 continues to suck ink mist and collects the ink mist continuously as shown in FIG. 8D.

As a result of repetition of the series of collecting operations as described above, UV ink which does not adhere to paper is adequately collected. Consequently, the interior of the printer 10 is adequately prevented from being contaminated by the UV ink.

Other Embodiments

Although the printer as an example of the fluid discharging apparatus has been mainly described on the basis of the embodiment described above, the embodiment of the invention described above is for easy understanding only and is not intended to limit the invention. The invention may be modified and improved without departing the scope of the invention and includes the equivalent devices as a matter of course.

Although the fluid discharging apparatus which discharges UV ink as an example of the fluid has been described in the embodiment descried above, the invention is not limited thereto. It is also possible to embody the invention in an apparatus which discharges liquid other than UV ink (ink other than UV ink, liquid other than ink, liquid-state substance having particles of functional material dispersed therein, fluid-state substance as gel) and fluid other than liquid (including solid state substances which may be flowed and discharged as fluid).

For example, a fluid discharging apparatus includes fluid discharging apparatuses which discharges liquid containing electrode material or colorant in the form of dispersion or dissolution used for manufacturing liquid crystal displays, EL (electroluminescence) displays, or surface emission-type displays, fluid discharging apparatuses which discharge biological organic substance used for manufacturing biochips, and fluid discharging apparatuses which are used as accurate pipettes and discharge fluid as a sample. Further more, it may be fluid discharging apparatuses which discharges lubricant for pinpoint lubrication for precise machines such as watches or cameras, fluid discharging apparatuses which discharges transparent resin liquid such as UV-cured resin on a substrate for forming micro-semispherical lens (optical lens) used for optical communication elements or the like, fluid discharging apparatuses which discharges etching liquid such as acid or alkali for etching the substrate or the like, a fluid-like substance discharging apparatus which discharges gel, or powder particle discharging recording apparatus which discharges solid substances, for example, powder such as toner. The invention may be applied to any one of the liquid discharging apparatuses.

Figure 9:
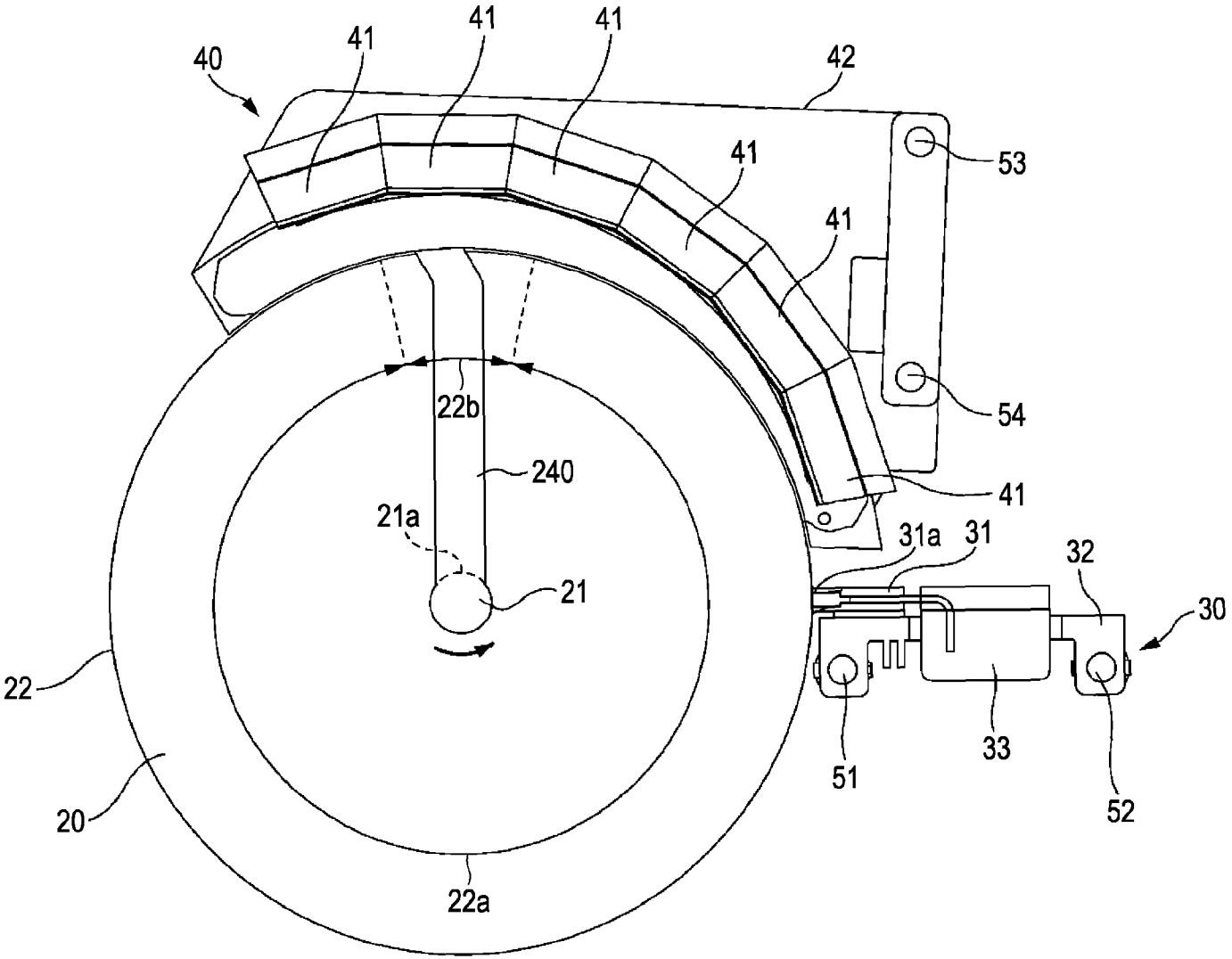
FIG. 9 is a drawing showing a duct 240 according to a modification.

In the embodiment described above, the duct 230 formed in the rotating drum 20 is formed into a convoluted form when viewed in the axial direction of the rotating shaft 21 of the rotating drum 20. Accordingly, UV ink is prevented from splashing out from the rotating drum 20 through the opening 23 by the centrifugal force F acting on the UV ink in the duct 230 by the rotation of the rotating drum 20 effectively, but the shape of the duct 230 is not limited to that in the embodiment shown above. The UV ink in the duct may be restrained from splashing out from the rotating drum 20 as long as the dust is at least a duct having a portion formed in the direction intersecting the direction from the center of the rotating drum 20 toward the opening 23 (desirably, a duct having the corresponding portion at the end on the side of the opening 23). Therefore, for example, it may be a duct 240 bent in the form of a broken line when viewed in the axial direction as shown in FIG. 9. FIG. 9 is a drawing showing the duct 240 according to a modification.

What is claimed is:

1. A fluid discharging apparatus comprising:

nozzles configured to discharge fluid to a medium;

a rotating member having a holding area configured to hold the medium and a non-holding area formed with an opening on a peripheral surface thereof and configured to rotate with the peripheral surface opposed to the nozzles; and a collecting mechanism configured to collect the fluid which does not adhere to the medium, the collecting mechanism including a suction unit configured to suck the fluid through the opening into the rotating member and a storage unit configured to store the fluid sucked into the rotating member, wherein the fluid is ultraviolet-cured ink, an irradiator having an irradiating surface configured to irradiate the ultraviolet-cured ink adhered to the medium with ultraviolet rays is provided, the rotating member rotates with the peripheral surface opposed to the irradiating surface, the collecting mechanism collects the ultraviolet-cured ink floating in a clearance between the irradiating surface and the peripheral surface of the rotating member by sucking the ultraviolet-cured ink into the rotating member through the opening by the suction unit and storing the ultraviolet-cured ink sucked into the rotating member in the storage unit.

2. The fluid discharging apparatus according to claim 1, wherein the collecting mechanism sucks the fluid into the rotating member through the opening by the suction unit and stores the fluid sucked into the rotating member in the storage in order to collect fluid discharged for flushing from the nozzles toward the opening.

3. The fluid discharging apparatus according to claim 1, wherein the irradiating surface is positioned downstream from the nozzles in terms of the direction of rotation of the rotating member, air flows into a clearance between the irradiating surface and the peripheral surface of the rotating member from an upstream end and a downstream end of the irradiating surface in terms of the direction of rotation when the collecting mechanism sucks ultraviolet-cured ink floating in the clearance between the irradiating surface and the peripheral surface of the rotating member by the suction unit, and the inflow resistance generated when air flows from the downstream end of the irradiating surface in terms of the direction of rotation into the clearance between the irradiating surface and the peripheral surface of the rotating member is smaller than the inflow resistance generated when air flows from the upstream end of the irradiating surface in terms of the direction of rotation into the clearance between the irradiating surface and the peripheral surface of the rotating member.

4. The fluid discharging apparatus according to claim 1, wherein the collecting mechanism includes a channel for fluid sucked through the opening, the channel being formed in the rotating member and rotating with the rotation of the rotating member, and the channel including a portion formed in the direction intersecting the direction from the center of the rotating member toward the opening.

5. The fluid discharging apparatus according to claim 4, wherein the channel is bent into a convoluted form when viewed in the direction of a rotating shaft of the rotating member.

* * * * *